United States Patent [19]

Slager et al.

[11] Patent Number: 4,570,400

[45] Date of Patent: Feb. 18, 1986

[54] CURTAIN WALL STUD SLIDE CLIP

[75] Inventors: Richard E. Slager, Prospect Heights; Henry A. Balinski, Hoffman Est., both of Ill.

[73] Assignee: United States Gypsum Company, Chicago, Ill.

[21] Appl. No.: 560,110

[22] Filed: Dec. 12, 1983

[51] Int. Cl.[4] ..... E04H 1/00

[52] U.S. Cl. ..... 52/235; 52/712; 403/347

[58] Field of Search ..... 52/235, 712, 715, 668, 52/667, 721, 573; 403/346, 347, 363

[56] References Cited

U.S. PATENT DOCUMENTS

| | | | |
|---|---|---|---|
| 2,905,286 | 9/1959 | Adams et al. | 52/668 X |
| 3,994,107 | 11/1976 | Aughuet | 52/235 |
| 4,121,391 | 10/1978 | Schroeder | 52/235 |

*Primary Examiner*—Carl D. Friedman

*Attorney, Agent, or Firm*—Robert M. Didrick; Samuel Kurlandsky; Robert H. Robinson

[57] ABSTRACT

A clip for connecting a curtain wall stud to the load bearing framework of a building is provided with detents so that the clip may be pushed onto the stud and does not have to be supported by hand while it is being welded to the framework.

2 Claims, 5 Drawing Figures

CURTAIN WALL STUD SLIDE CLIP

This invention relates to the construction of buildings which utilize a load bearing skeletal framework and non-load bearing curtain walls which are connected to the framework. The framework comprises a plurality of spaced-apart vertical columns which support horizontal beams which, in turn, support the floors and roof of the building. The live loads applied to the floors and roof change frequently and, thus, the beams are subject to significant vertical deflections. The floors and roof are designed to withstand such deflections but the curtain walls must be isolated from the movement to prevent the damage which would otherwise result from the compressive forces generated by the movement.

In U.S. Pat. No. 4,121,391, Schroeder teaches a slotted, L-shaped metal clip, both legs of which fit over a flange of a curtain wall stud. A first leg of the clip is welded to a peripheral horizontal beam along the edge of a floor of the building. This first leg is segmented by an open-ended slot which extends part way into the body of the second leg. The flange is said to fit snugly in the slot, which is slightly wider than the thickness of the flange. Thus, a C-shaped curtain wall stud is connected to the building's framework by holding the stud upright against a horizontal beam so that a flange of the stud stands away from and is perpendicular to the beam, slipping the clip over the flange, and holding the stud and the clip in place while welding the clip to the beam.

It is an object of this invention to provide a more convenient means for connecting a curtain wall stud to the load bearing framework of a building.

It is a related object of this invention to provide a curtain wall slide clip which does not need to be held separately in place while it is being welded to the framework.

It is another object of this invention to provide a slide clip by which the restraint against horizontal movement of the curtain wall stud is delocalized.

It is a further object of this invention to provide an improved method for constructing a curtain wall.

These and other objects of this invention which will become apparent are achieved by the clip and its use which are illustrated by the attached drawings and the following description.

Figure 1:
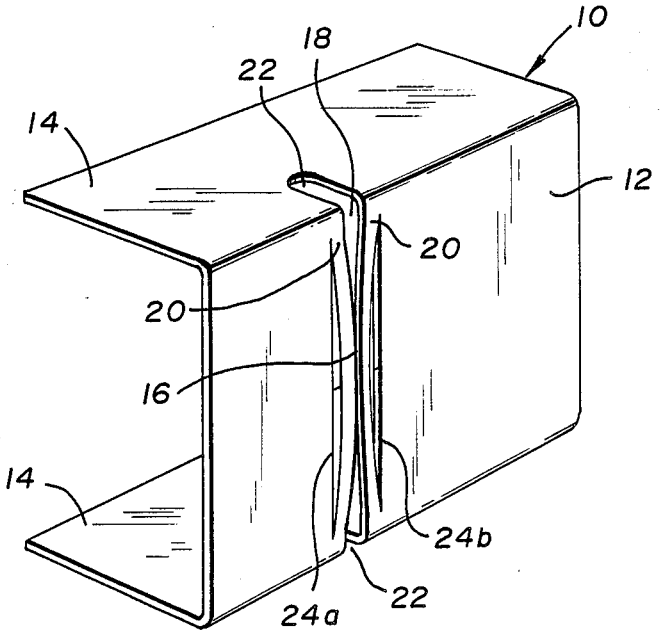
FIG. 1 is a perspective view of one embodiment of the clip of this invention.
Figure 2:
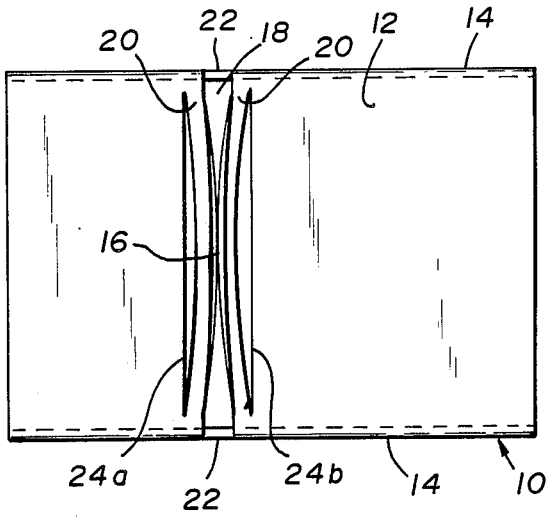
FIG. 2 is a front elevational view of the clip of FIG. 1.

In FIGS. 1 and 2, the curtain wall slide clip 10 is made of sheet steel and is comprised of the strut 12 and the pair of fins 14. The spring clamp 16 is formed within the slot 18 by the converging stays 20. The notches 22 are continuations of the slot 18. The stays 20 are formed by piercing the strut along the lines 24*a* and 24*b*, thereby pushing the resulting metal strips partially into the slot 18, and bending the strips inward between the fins 14.

Figure 3:
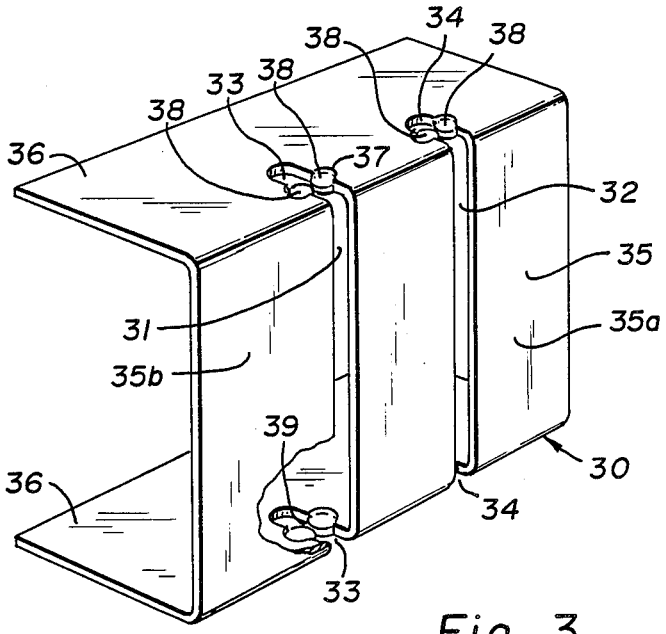
FIG. 3 is a perspective view of another embodiment of the clip of this invention.

In FIG. 3, the clip 30 is adapted to fit over curtain wall studs having either of two common flange widths. Here, the slots 31 and 32 and the notches 33 and 34 are formed in the strut 35 and the fins 36, respectively. A dimple 37 is stamped into the metal bordering each side of the notches, thereby forming the tabs 38 as some of the metal is forced to expand into the notches. Each pair of tabs constitutes a detent 39. The slots 31 and, at their widest dimension, the notches 33 and 34 are of equal width but notch 34 is shorter than notch 33 and is positioned so that segment 35*a* of the strut 35 will fit within a 1.25 inch wide flange while segment 35*b* will fit within a 1.75 inch wide flange but not the narrower one. Because the double-slotted clip 30 will accommodate either size, there is no necessity to keep separate stocks of single-slotted clips.

Figure 4:
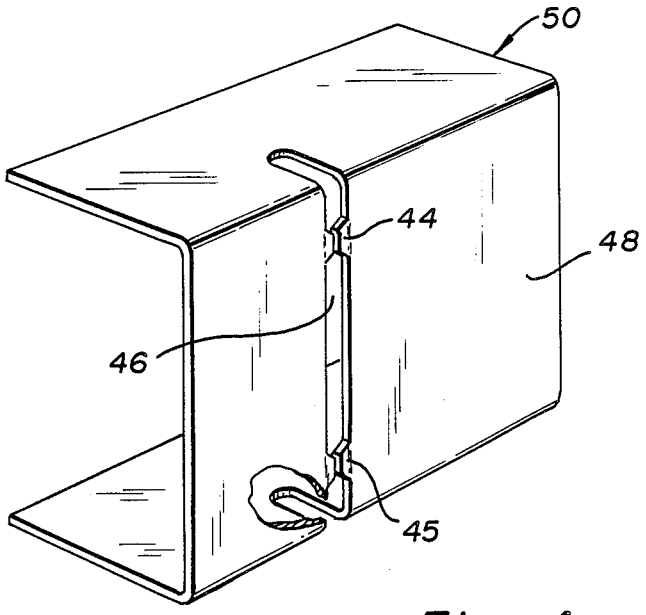
FIG. 4 is a perspective view of another embodiment of the clip of this invention.
Figure 5:
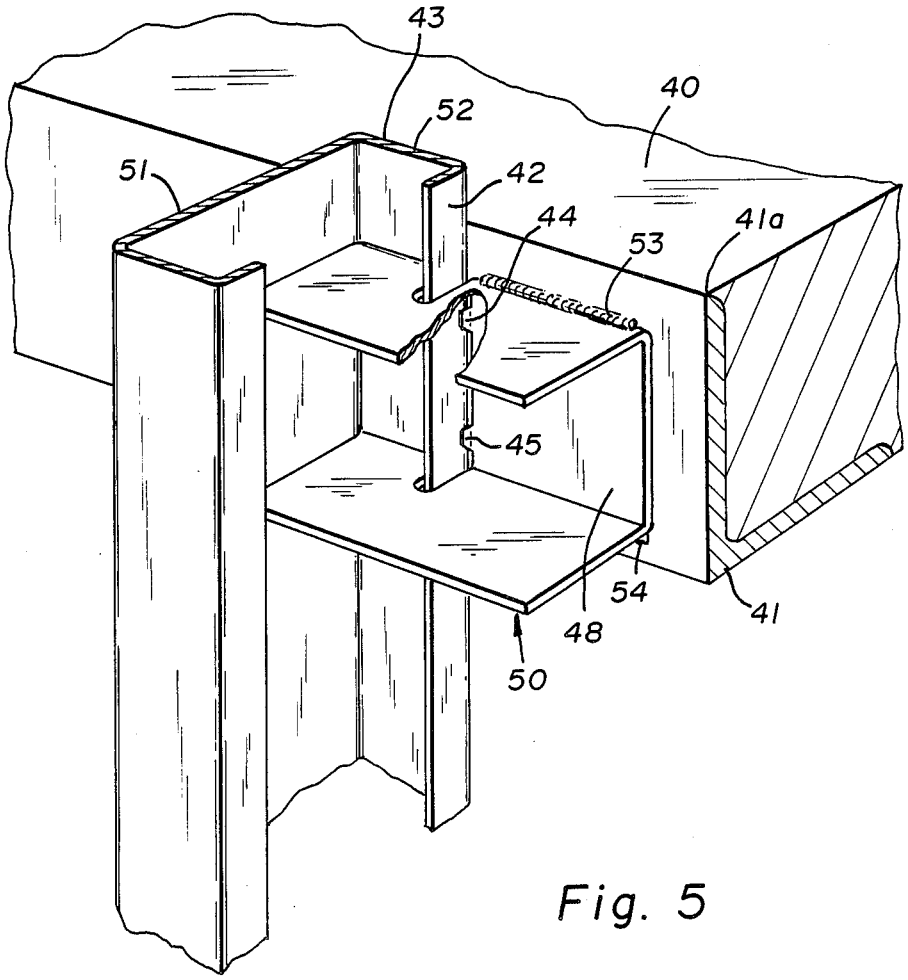
FIG. 5 is a perspective view, partially cut away, of a portion of a building showing a curtain wall stud connected to the framework by the clip of FIG. 4.

In FIG. 5, the concrete floor slab 40 and the horizontal structural member 41 are part of the load bearing framework of a building. The lip 42 of C-shaped curtain wall stud 43 is pinched between the tab pairs 44 and 45 which protrude from the margins of the slot 46 in the strut 48 of the clip 50 of FIG. 4 so that the web 51 is perpendicular to and the flange 52 is substantially parallel to the upright 41*a* of member 41. The clip 50 is fastened to the member 41 by the welds 53 and 54. The paired tabs 44 and 45 are bent inward to grasp the lip 42 so that the clip 50 will remain in place without further support after it has been pushed by hand or tapped lightly with a hammer into place before being welded to the member 41.

The frictional engagement of the stud by the detent of the clip is sufficient to hold the weight of the clip before the clip is welded to the horizontal beam but the friction is not so great that it prevents the clip from sliding down the stud when the horizontal beam moves vertically under a live load. Horizontal movement of the stud is restrained at a plurality of points, the number being equal to one-half of the number of detent pairs.

While several particular embodiments of this invention have been described, it will be understood that the invention may be modified within the spirit and scope of the appended claims.

The subject matter claimed is:

1. A slide clip adapted for connecting a curtain wall stud, the stud having a web, a flange perpendicular to the web, and a return lip perpendicular to the flange, to the load bearing framework of a building, said clip comprising a strut, a pair of congruent fins integral with, spaced apart by, and extending laterally from the strut, said strut having a slot therein which extends into each of the fins, each fin having a notch therein which is a continuation of said slot, and a pair of convergent strips cut from but integral with the strut which protrude into the slot to form a clamp adapted to frictionally engage the lip of the stud, said clamp being sufficient to support the weight of the clip but insufficient to resist a vertical force applied to the clip.

2. In a building having a load bearing skeletal framework of vertical columns and horizontal beams; a plurality of spaced-apart curtain wall studs juxtaposed with the beams, each stud having a lip perpendicular to a beam; and a plurality of slide clips, each clip comprising a strut which rests astride a lip of a stud and is joined to a beam and a pair of congruent fins integral with, spaced apart by, and extending laterally from the strut; an improved slide clip which comprises:

a strut having a slot therein which extends into each of the fins, each fin thereby having a notch therein, and a detent which protrudes from at least one lateral margin of the slot toward the opposite margin and which engages the stud lip, said engagement being frictionally sufficient to support the weight of the clip but insufficient to resist a vertical force applied to the clip.

* * * * *